US012140009B2

(12) United States Patent
Ben-Zvi et al.

(10) Patent No.: US 12,140,009 B2
(45) Date of Patent: Nov. 12, 2024

(54) STEAM-ENHANCED HYDROCARBON RECOVERY USING HYDROGEN SULFIDE-SORBENT PARTICLES TO REDUCE HYDROGEN SULFIDE PRODUCTION FROM A SUBTERRANEAN RESERVOIR

(71) Applicant: Cenovus Energy Inc., Calgary (CA)

(72) Inventors: Amos Ben-Zvi, Calgary (CA); Michael Patrick McKay, Calgary (CA); Paulina Morasse, Calgary (CA); Simon Gittins, Calgary (CA)

(73) Assignee: CENOVUS ENERGY INC., Calgary (CA)

( * ) Notice: Subject to any disclaimer, the term of this patent is extended or adjusted under 35 U.S.C. 154(b) by 0 days.

(21) Appl. No.: 17/817,193

(22) Filed: Aug. 3, 2022

(65) Prior Publication Data

US 2023/0045845 A1 Feb. 16, 2023

Related U.S. Application Data

(60) Provisional application No. 63/229,926, filed on Aug. 5, 2021.

(51) Int. Cl.
*E21B 43/24* (2006.01)

(52) U.S. Cl.
CPC ..... *E21B 43/2406* (2013.01)

(58) Field of Classification Search
CPC ... E21B 43/2406; E21B 43/2408; C09K 8/52; C09K 8/528; C09K 8/532; C09K 8/536;
(Continued)

(56) References Cited

U.S. PATENT DOCUMENTS 4,008,775 A * 2/1977 Fox ..... C09K 8/54 507/140
4,956,160 A * 9/1990 Reichert ..... B01D 53/52 502/316

(Continued)

FOREIGN PATENT DOCUMENTS

CA 2897078 A1 1/2016
CA 2915623 A1 6/2017

(Continued)

OTHER PUBLICATIONS

Ravinder Kumar, et al. The role of nanotechnology on post-combustion CO2 absorption in process industries, International Journal of Low-Carbon Technologies, vol. 15, Issue 3, Aug. 2020, pp. 361-367.

(Continued)

*Primary Examiner* — Angela M DiTrani Leff
(74) *Attorney, Agent, or Firm* — ARENTFOX SCHIFF LLP

(57) ABSTRACT

A method is provided for producing hydrocarbons from a subterranean reservoir. A mixture of steam and $H_2S$-sorbent particles (e.g., nanoparticles) is injected into the subterranean reservoir. This may be performed during the steam phase of a steam injection operation, such as steam assisted gravity drainage (SAGD), steam flooding, or cyclic steam stimulation, which is performed on the reservoir. The injected steam reduces the viscosity of the hydrocarbons in the subterranean formation. The injected $H_2S$-sorbent particles attach to the subterranean reservoir and adsorb $H_2S$ therein. The hydrocarbons are produced to the surface, without producing the $H_2S$-sorbent particles with adsorbed $H_2S$ that remain attached to the subterranean reservoir.

13 Claims, 6 Drawing Sheets

(58) Field of Classification Search
CPC ..... C09K 8/592; C09K 8/60; C09K 8/594; C09K 8/62; C09K 8/80; C09K 2208/10; C09K 2208/20
See application file for complete search history.

(56) References Cited

U.S. PATENT DOCUMENTS

| | | | | |
|---|---|---|---|---|
| 6,447,577 | B1 * | 9/2002 | Espin | C10G 25/00 166/279 |
| 9,567,510 | B2 * | 2/2017 | Salla | C09K 8/532 |
| 11,708,517 | B1 * | 7/2023 | Onaizi | C09K 8/16 166/304 |
| 2002/0157536 | A1 | 10/2002 | Espin et al. | |
| 2011/0278001 | A1 * | 11/2011 | Schneider | E21B 43/166 166/272.3 |
| 2016/0115365 | A1 * | 4/2016 | Bulte-Loyer | C04B 28/32 166/293 |
| 2017/0058186 | A1 * | 3/2017 | Oghena | C09K 8/592 |
| 2019/0100684 | A1 * | 4/2019 | Elkatatny | C09K 8/16 |
| 2019/0309213 | A1 * | 10/2019 | Chakraborty | C09K 8/532 |

FOREIGN PATENT DOCUMENTS

| | | | | |
|---|---|---|---|---|
| CA | 2916141 | A1 | 6/2017 | |
| WO | WO-2007041553 | A1 * | 4/2007 | B01D 15/00 |
| WO | 2008070990 | A1 | 6/2008 | |

OTHER PUBLICATIONS

Kim, Jinguk et al. CO2 Separation using Surface-functionalized SiO2 Nanoparticles incorporated Ultra-Thin Film Composite Mixed Matrix Membranes for Post-combustion Carbon Capture. 2016. Journal of Membrane Science. 515.
Lin, Kun-Yi Andrew et al. Effects of bonding types and functional groups on CO2 capture using novel multiphase systems of liquid-like nanoparticle organic hybrid materials. Environmental Science Technology. Aug. 1, 2011; 45(15):6633-9.
Ota, Misaki et al. CO2 Adsorption Property of Amine-Modified Amorphous TiO2 Nanoparticles with a High Surface Area. Colloids Interfaces 2018, 2, 25.
Zhang, Huiying & Liu, Ruiqiang & Ning, Tangyuan & Lal, Rattan. Higher CO2 absorption using a new class of calcium hydroxide (Ca(OH)2) nanoparticles. Environmental Chemistry Letters. 2018. 16. pp. 1095-1100.
Wan Nor Roslam Wan Isahak et al. Enhancement of CO2 Capture Using CuO Nanoparticles Supported on Green Activated Carbon. Advanced Materials Research. 2015. 1087. pp. 111-115.
Mishra, Ashish et al. Nano magnetite decorated multiwalled carbon nanotubes: A robust nanomaterial for enhanced Carbon Dioxide adsorption. Energy Environ. Sci . . . 2011. 4. pp. 889-895.
Planetary Hydrogen, "Technology", online: <https://www.planetaryhydrogen.com/technology/> , retrieved Jul. 3, 2021.
Awume, Bennet. Control of Hydrogen Sulphide Emissions Using Zinc Oxide Nanoparticles. University of Saskatchewan. Jul. 2014.
Sekhavatjou, M.S. et al. A New Method for Sulphur Components Removal From Sour Gas Through Application of Zinc and Iron Oxides Nanoparticles. International Journal of Environmental Research (IJER) 2014. 8(2), pp. 273-278.
Abdelrahman Ibrahim El-Diasty, SPE, The American University in Cairo (AUC) and Suez University, Egypt and Adel M. Salem Ragab. Applications of Nanotechnology in the Oil & Gas Industry: Latest Trends Worldwide & Future Challenges in Egypt. Society of Petroleum Engineers. 2013.
S. I. Martinez, PDVSA Intevep S.A.; C. Bastidas, Universidad Nacional Experimental Politécnica de la Fuerza Armada. Application of Transition Metal Nanoparticles in the Streams Production of Heavy Crude Oil Treatment: H2S Mitigation. Society of Petroleum Engineers. 2017.
Christof Weinlaender et al. Low-temperature H2S removal for solid oxide fuel cell application with metal oxide adsorbents. Adsroption Science & Technology. Oct. 7, 2016. 35(1-2). pp. 120-136.
S. L. Whittaker, Clean Stream Technologies Middle East FZE. Use of NanoActive® Sulphur Scavenger NASS for H2S Removal in the Oil and Gas Industry. Society of Petroleum Engineers. 2018.
Amvrosios G. Georgiadis, Nikolaos D. Charisiou and Maria A. Goula. Removal of Hydrogen Sulfide From Various Industrial Gases: A Review of The Most Promising Adsorbing Materials. Catalysts. May 8, 2020. 10, 521.
Syed Mubeen, Ting Zhang, Nicha Chartuprayoon, Youngwoo Rheem, Ashok Mulchandani, Nosang V. Myung, and Marc A. Deshusses. Sensitive Detection of H2S Using Gold Nanoparticles Decorated SWNTs. Anal. Chem. 2010; 82(1); 250-257.
Izabela Konkol, Jan Cebula, Adam Cenian. Oxidization of hydrogen sulphide in biogas by manganese (IV) oxide particles. Aug. 14, 2019. Environ. Eng. Res. 2021; 26(20; 190343, (6 Pages Total).
Wang, De Ming. "Breakthrough behavior of H2S removal with an iron oxide based CG-4 adsorbent in a fixed-bed reactor." Thesis, University of Saskatchewan. Sep. 2008.
Costa, C.; Cornacchia, M.; Pagliero, M.; Fabiano, B.; Vocciante, M.; Reverberi, A.P. Hydrogen Sulfide Adsorption by Iron Oxides and Their Polymer Composites: A Case-Study Application to Biogas Purification. Materials 2020, 13, 4725.
Blatt, O., Helmich, M., Steuten, B., Hardt, S., Bathen, D. and Wiggers, H. (2014), Iron Oxide/Polymer-Based Nanocomposite Material for Hydrogen Sulfide Adsorption Applications. Chem. Eng. Technol., 37: 1938-1944.
Georgiadis, A.G.; Charisiou, N.D.; Yentekakis, I.V.; Goula, M.A. Removal of Hydrogen Sulfide (H2S) Using MOFs: A Review of the Latest Developments. Chem. Proc. 2020, 2, 27.
Nabipoor Hassankiadeh, Mojtaba & Hallajisani, Ahmad. (2020). Abstract of Application of Molybdenum oxide nanoparticles in H2S removal from natural gas under different operational and geometrical conditions. Journal of Petroleum Science and Engineering. 190.

* cited by examiner

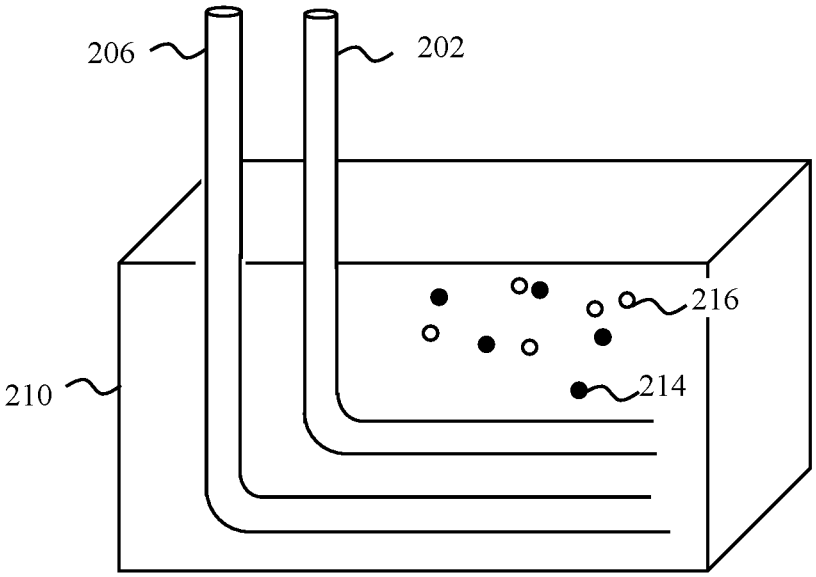
FIG. 3A
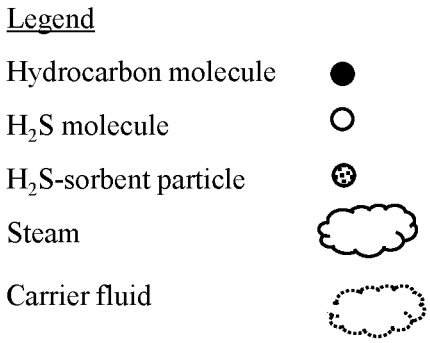

STEAM-ENHANCED HYDROCARBON RECOVERY USING HYDROGEN SULFIDE-SORBENT PARTICLES TO REDUCE HYDROGEN SULFIDE PRODUCTION FROM A SUBTERRANEAN RESERVOIR

CROSS-REFERENCE TO RELATED APPLICATION(S)

This Application claims priority of U.S. Provisional Application No. 63/229,926 entitled "STEAM-ENHANCED HYDROCARBON RECOVERY USING HYDROGEN SULFIDE-SORBENT PARTICLES TO REDUCE HYDROGEN SULFIDE PRODUCTION FROM A SUBTERRANEAN RESERVOIR" filed on Aug. 5, 2021, the disclosure of which is expressly incorporated by reference herein in its entirety.

FIELD OF THE INVENTION

The present invention relates to production of hydrocarbons from a subterranean reservoir using steam injection to enhance production, such as in a SAGD well system, and more particularly to use of a particle, which may be a nanoparticle, to adsorb hydrogen sulfide in the subterranean reservoir to reduce hydrogen sulfide ($H_2S$) production to the surface.

BACKGROUND OF THE INVENTION

Steam Injection Including Steam Assisted Gravity Drainage to Enhance Hydrocarbon Production.

In general, steam injection is a technique for enhancing production of hydrocarbons from a subterranean reservoir to the surface by injecting steam into a reservoir to reduce the viscosity of hydrocarbons in the reservoir, so that the hydrocarbons flow more readily to a producing well.

Steam assisted gravity drainage (SAGD) is an example of steam injection that involves injecting steam from the surface into an upper horizontal well (an injection well) disposed in the reservoir above a lower horizontal well (a production well). The injected steam exits the injection well and rises in the reservoir to form a steam-saturated zone, which is conceptualized as a "steam chamber", where hydrocarbons are heated by the steam and thereby reduced in viscosity. The reduced-viscosity hydrocarbons drain downward by gravity into the production well, and are produced to the surface.

Hydrogen Sulfide Removal from Produced Oil and Natural Gas Streams.

Crude oil and natural gas produced from reservoirs may have high concentrations of hydrogen sulfide ($H_2S$). $H_2S$ is a dangerous, toxic, and corrosive gas.

Methods are available for treating and removing $H_2S$ from crude oil and natural gas streams after they have been produced to the surface. For example, the gas phase gas can be reacted with amines (i.e., alkylamines) in an absorber tower, but this is capital intensive. The gas phase and the liquid phase can be reacted with triazine-based scavengers, but this is not effective for high concentrations of $H_2S$, or high levels of the liquid phase. The gas phase can be incinerated, but this has high greenhouse gas impacts.

Further, the Alberta Energy and Utilities Board, Interim Directive ID 2001-3, titled "Sulphur Recovery Guidelines for the Province of Alberta" (Aug. 29, 2001) requires higher sulphur recovery requirements as the rate of sulphur being processed increases. For example, these Guidelines require 70% and a 99.8% sulphur recovery rates at sulphur inlet rates of 1-5 tonnes and 2000 tonnes per day, respectively.

Prior Art.

U.S. patent application publication no. 2002/0157536 A1 (Espin et al.; Oct. 31, 2002), titled "Method for Removing $H_2S$ an $CO_2$ from Crude and Gas Streams" discloses positioning a metal-containing nanoparticle in a stream containing $H_2S$, with the metal-containing nanoparticle being selected from metal oxides, metal hydroxides and combinations thereof, whereby the nanoparticles adsorb the contaminants from the stream. In one embodiment, Espin et al. discloses that the stream is a downhole stream established from a hydrocarbon producing subterranean formation, and the nanoparticles are positioned in fractures induced into formation in the form of proppants and/or additives to proppants. The hydrocarbon stream produced through the fractures is exposed to the nanoparticles and $H_2S$ is adsorbed downhole.

PCT International patent application publication no. WO 2008/070990 (Larter et al.; Jun. 19, 2008), titled "Preconditioning an Oilfield Reservoir" discloses a method of enhancing recovery of a petroleum product in an oilfield reservoir that includes heavy or bitumen. The method involves injecting water including a preconditioning agent into a mobile water film included in the oilfield reservoir, and preconditioning the reservoir with the preconditioning agent prior to production of the petroleum product form the oilfield reservoir. Larter et al. discloses embodiments where the preconditioning agent includes hydrogen sulfide to modify the viscosity of oil in the reservoir. Larter et al. discloses other embodiments where the precondition agent contains a water soluble sulphate to make hydrogen sulfide in the reservoir to enliven oil being produced and hence improve recovery. Larter et al. discloses still other embodiments where the preconditioning is performed to modify magnetic properties of the reservoir, and the preconditioning agent may include magnetite nanoparticles, such as nanomagnetite or magnetite, complexed with multidentate carboxylic.

S. I. Martinez, and C. Bastidas, in "Application of Transition Metal Nanoparticles in the Streams Production of Heavy Crude Oil Treatment: $H_2S$ Mitigation", (2017) Society of Petroleum Engineers, 2017, disclose experiments to simulate application of iron oxide, copper oxide, and nickel oxide nanoparticles during temperature and pressure conditions of steam injection for oil production. Martinez et al. uses a high vacuum gas oil (HVGO) (an aromatic solvents mixture) as a carrier fluid for the nanoparticles. Martinez et al., however, does not indicate how such carrier fluid might be used in relation to a steam injection process. Use of such a carrier fluid would add cost and complexity to hydrocarbon production.

There remains a need in the art for methods of producing hydrocarbons from a subterranean reservoir using a steam injection operation, including from a SAGD well system, and reducing the amount of $H_2S$ that is produced to the surface. Doing so may help to reduce corrosion of surface equipment, improve safety of personnel at the surface, and comply with regulations regarding sulfur recovery.

SUMMARY OF THE INVENTION

In one aspect, the present invention comprises a method for producing hydrocarbons from a subterranean reservoir. The method comprises the steps of: (a) injecting a mixture of steam and $H_2S$-sorbent particles into the subterranean reservoir; (b) allowing the steam to reduce viscosity of the hydrocarbons in the subterranean reservoir, and allowing the $H_2S$-sorbent particles to attach to the subterranean reservoir; (c) allowing the $H_2S$-sorbent particles to adsorb hydrogen sulfide ($H_2S$) in the subterranean reservoir; and (d) producing the hydrocarbons to the surface (i.e., to ground level), without producing the $H_2S$-sorbent particles with adsorbed $H_2S$ that remain attached to the subterranean reservoir.

In one embodiment, the method is implemented using a single well. That is, in step (a), the mixture of steam and $H_2S$-sorbent particles are injected into the subterranean reservoir via a well. In step (d), the hydrocarbons are produced to the surface via the well that was used in step (a) to inject the mixture of steam and $H_2S$-sorbent particles into the subterranean reservoir.

In other embodiments, the method is implemented using a pair of wells, such as used in a steam flooding operation (also known as a steam drive operation), or in a SAGD operation. That is, in step (a), the mixture of steam and $H_2S$-sorbent particles is injected into the subterranean reservoir via a first well. In step (d), the hydrocarbons are produced to the surface via a second well that is different from the first well. In a particular embodiment, the pair of wells is implemented by a SAGD well system, wherein the first well in an injection well comprising a horizontal or deviated injection well leg, and the second well is a production well comprising a horizontal or deviated production well leg below the injection tubing leg. In such embodiment, the method comprises, after step (c) and before step (d), the further step of allowing hydrocarbons in the subterranean reservoir to drain by gravity into the production well leg, while the $H_2S$-sorbent particles with adsorbed $H_2S$ remain attached to the subterranean reservoir.

In embodiments of the method implemented using a first well and second well, as described above, the method may comprise, either before or after step (a), the further steps of: (e) injecting a mixture of a carrier fluid and additional $H_2S$-sorbent particles into the subterranean formation via the second well; (f) allowing the additional $H_2S$-sorbent particles to adsorb hydrogen sulfide ($H_2S$) in the subterranean reservoir; and (g) producing the hydrocarbons to the surface, without producing the additional $H_2S$-sorbent particles with adsorbed $H_2S$ that remain attached to the subterranean reservoir. The carrier fluid may be either a liquid, such as water, or a gas, such as nitrogen.

In embodiments of the method, step (a) of injecting the mixture of steam and $H_2S$-sorbent particles creates a first region of $H_2S$-sorbent particles and a second region of $H_2S$-sorbent particles in the subterranean reservoir, wherein a concentration of $H_2S$-sorbent particles in the first region is higher than a concentration of $H_2S$-sorbent particles, if any, in the second region. The method may further comprise establishing a pressure gradient in the subterranean reservoir that directs $H_2S$ to flow through the first region in preference to the second region.

In embodiments of the method, steps (a) to (d) are performed in a first cycle, and then steps (a) to (d) are repeated in a second cycle. In such embodiments, step (a) of the first cycle may inject a first amount or concentration of $H_2S$-sorbent particles in the mixture into the subterranean formation, and step (a) of the second cycle may inject a second amount or concentration of $H_2S$-sorbent particles in the mixture into the subterranean formation, wherein the second amount or concentration is different from the first amount or concentration.

In embodiments of the method, the $H_2S$-sorbent particles comprise a material selected from the group comprising a metal-organic framework (MOF), zinc oxide (ZnO), iron oxide ($Fe_2O_3$), magnetite ($Fe_3O_4$), copper oxide (CuO), nickel oxide (NiO), calcium oxide (CaO), manganese oxide ($MnO_2$), and molybdenum oxide ($MoO_2$).

The present invention may allow for a reduction of the amount of $H_2S$, if any, that is produced to the surface. Injection of the $H_2S$-sorbent particles may be performed during the steam phase of the steam injection operation, such as SAGD operations, cyclic steam stimulation, and steam flooding. This may be advantageous in that the conventional workflow of the steam injection operation is not materially altered by the need to inject a carrier fluid into the subterranean reservoir.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

FIGS. 3A to 3F are schematic depictions of sequential stages of the method of FIG. 1.

FIG. 3A shows a subterranean reservoir in relation to an injection tubing and production tubing of a SAGD well system.

FIG. 3B shows injection of a carrier fluid mixed with $H_2S$-sorbent particles into the subterranean reservoir via the production tubing.

FIG. 3C shows injection of steam mixed with $H_2S$-sorbent particles into the subterranean reservoir via the injection tubing.

FIG. 3D shows $H_2S$-sorbent particles attached to sand in the subterranean reservoir, and adsorbing $H_2S$ molecules in the subterranean reservoir.

FIG. 3E shows hydrocarbons draining by gravity into the production tubing, while the $H_2S$-sorbent particles with adsorbed $H_2S$ remain attached to the subterranean reservoir.

FIG. 3F shows production of hydrocarbons to the surface via the production tubing string.

DETAILED DESCRIPTION OF EMBODIMENTS OF THE INVENTION

Definitions

Figure 1:
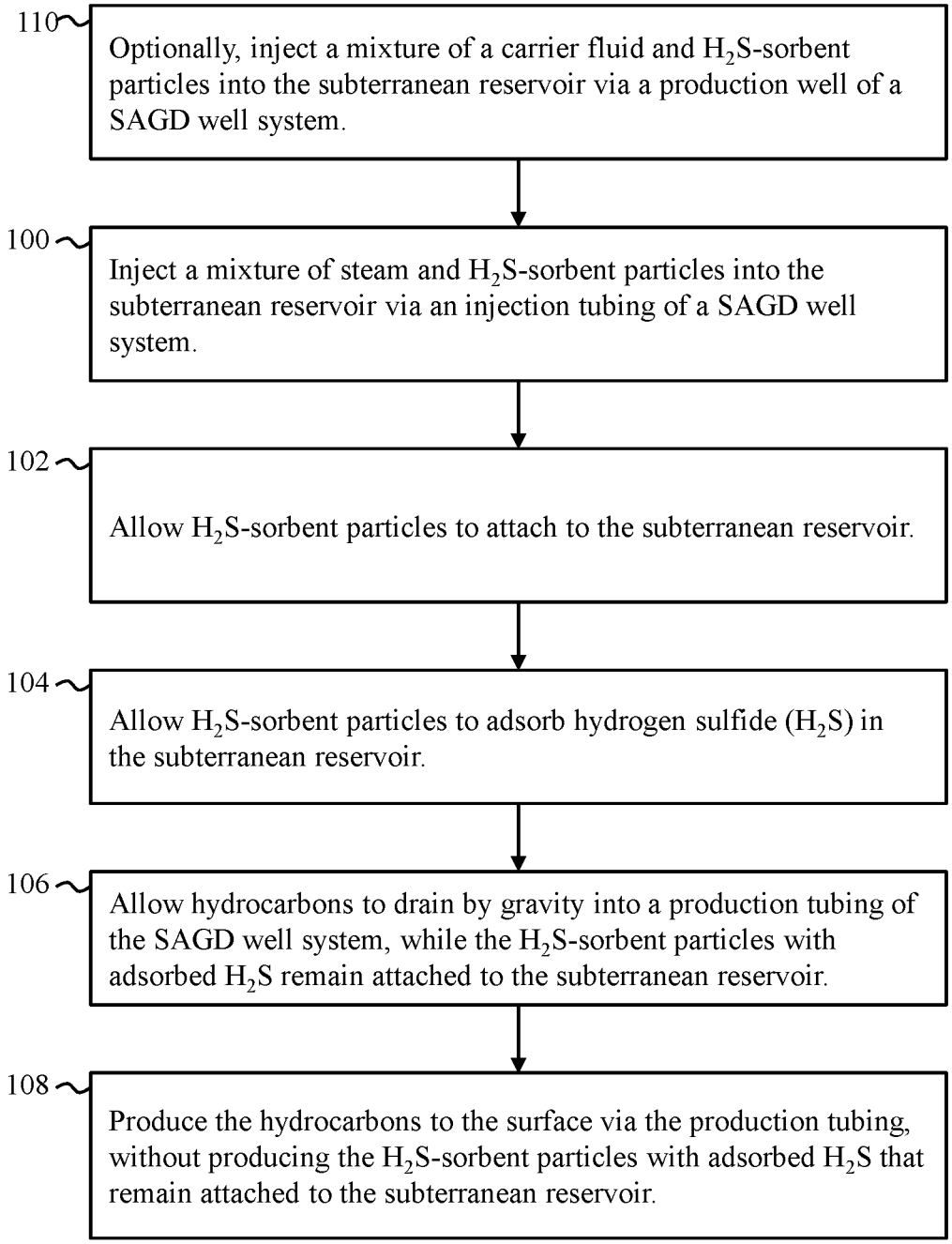
FIG. 1 is a flow chart of a first embodiment of a method of the present invention, for production of hydrocarbons from a subterranean reservoir using a steam assisted gravity drainage (SAGD) well system, and using $H_2S$-sorbent particles to adsorb $H_2S$ in the subterranean reservoir.

The present invention relates to production of hydrocarbons from a subterranean reservoir using a steam injection operation, and $H_2S$-sorbent particles to adsorb hydrogen sulfide ($H_2S$) in the subterranean reservoir to reduce the amount of $H_2S$, if any, produced to the surface.

Any term or expression not expressly defined herein shall have its commonly accepted definition understood by a person skilled in the art. As used herein, the following terms have the following meanings.

"Subterranean reservoir" refers to a subsurface body of rock having porosity and permeability that is sufficient to permit storage and transmission of a liquid or gaseous fluid.

"Steam chamber", in the context of a SAGD well system, refers to a region a subterranean reservoir that is in fluid and pressure communication with an injection well, and that is subject to depletion of hydrocarbons, by gravity drainage, into a production well that is disposed parallel and below the injection well.

"Steam injection operation" refers to any method of producing hydrocarbons from a subterranean reservoir that involves injection of steam into the subterranean reservoir to decrease the viscosity of the hydrocarbons, so that the hydrocarbons flow more easily in the subterranean reservoir. Without limitation, steam injection operations include methods known in the art as steam assisted gravity drainage (SAGD), steam flooding or steam drive, and cyclic steam stimulation (CSS).

"Hydrocarbons" refer to hydrocarbon substances naturally occurring in a subterranean reservoir. Hydrocarbons may be in liquid, gaseous, or solid phases. Without limitation, hydrocarbons may include "heavy oil", referring to hydrocarbons having a mass density of greater than about 900 kg/m$^3$ under natural reservoir conditions. Without limitation, hydrocarbons may also include "bitumen" having a mass density of greater than about 1,000 kg/m$^3$ under natural reservoir conditions, and existing in semi-solid or solid phase under natural reservoir conditions. It will be understood that "hydrocarbon production", "producing hydrocarbons" and like terms, as used herein, do not preclude co-production of non-hydrocarbon substances that may be mixed with hydrocarbons such as trace metals, and gases such as hydrogen sulfide that may be dissolved under natural reservoir conditions, but exist in a gaseous phase at surface conditions.

"$H_2S$-sorbent particle" refers to a particle that has an affinity for $H_2S$. In embodiments, this affinity may be based on principles of adsorption—i.e., the $H_2S$-sorbent particle physically adheres and/or chemically bonds to $H_2S$. In embodiments, the $H_2S$-sorbent particle has a maximum dimension (e.g., a diameter) less than about 1000 nm, more particularly less than 500 nm, more particularly less than 250 nm. In embodiments, the $H_2S$-sorbent particle is a "nanoparticle", which as used herein, refers to a particle that has a maximum dimension less than 100 nm. In embodiments, a nanoparticle may have a maximum dimension less than 50 nm, and more particularly less than 25 nm.

Metal-organic framework", and its abbreviation "MOF", refers to a porous material formed by compounds comprising metal ions or metal-ion clusters coordinated to organic ligands.

Method.

FIG. 1 is a flow chart of a first embodiment of a method of the present invention, for production of hydrocarbons from a subterranean reservoir using a steam assisted gravity drainage (SAGD) well system, and using $H_2S$-sorbent particles to adsorb hydrogen sulfide in the subterranean reservoir.

Figure 2:
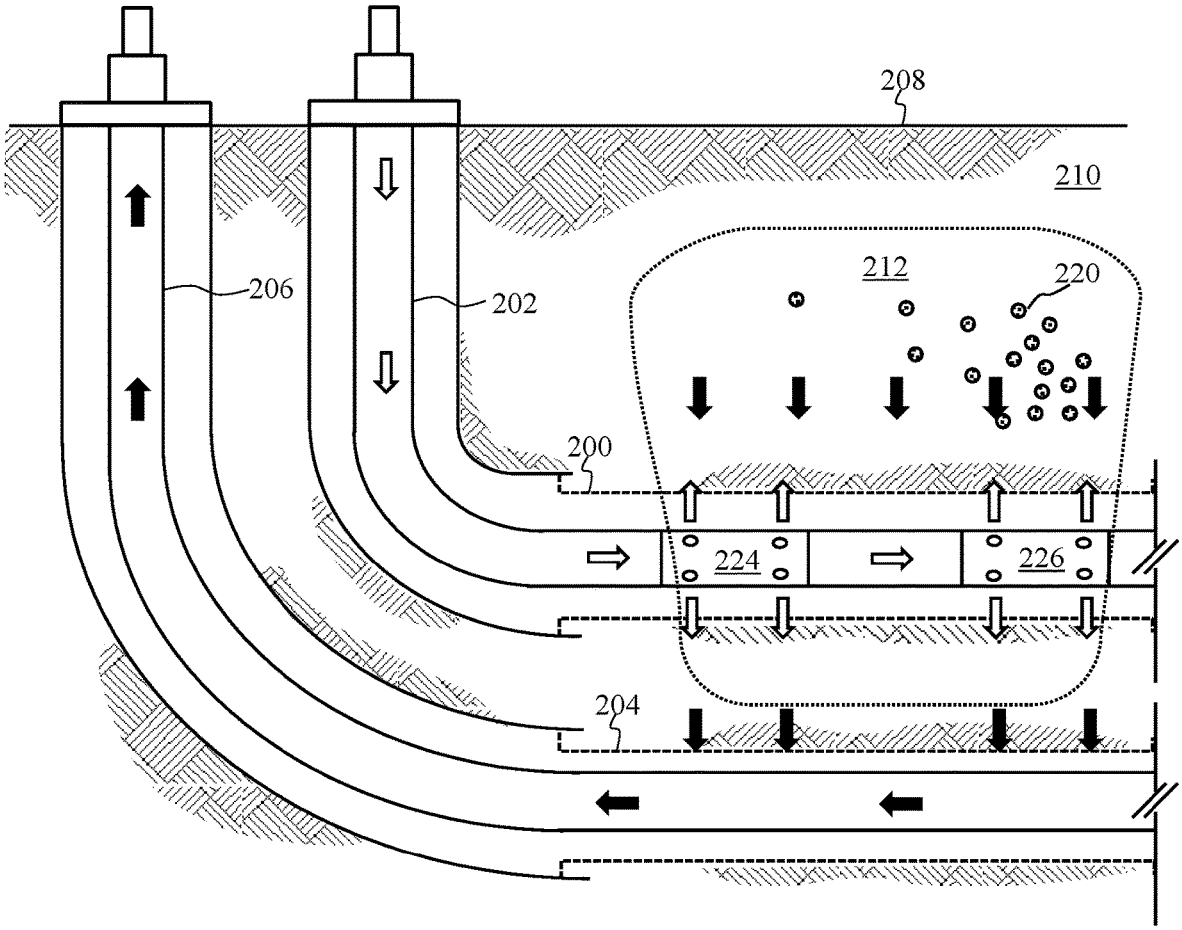
FIG. 2 is a schematic depiction of a SAGD well system that may be used in implementing the method of FIG. 1, along with $H_2S$-sorbent particles attached to the subterranean reservoir.

FIG. 2 is a schematic depiction of a SAGD well system that may be used in implementing the method of FIG. 1. SAGD well systems and their principle of operation are well known to persons skilled in the art. The following description is provided to facilitate understanding of the present invention. For simplicity of illustration, FIG. 2 omits various equipment items (e.g., steam generators, surface pumps, downhole pumps, sealing elements and so forth) that are commonly associated with a SAGD well system. The SAGD well system includes a horizontal or deviated (i.e. non-vertical) leg of an injection well 200 including an injection tubing 202, and a horizontal or deviated (i.e. non-vertical) leg of a production well 204 including a production tubing 206, extending from the surface 208 into a subterranean reservoir 210. The production well 204 is parallel to the injection well 200, and disposed below the injection well 200. A surface pump (not shown) is used to inject steam (as shown by hollow arrows) into the injection tubing 202, which exits via openings thereof, and through openings (e.g., a slotted liner) of the injection well 200 into a subterranean reservoir so as to create a steam-saturated zone referred to as the steam chamber 212. In the steam chamber 212, the injected steam heats the hydrocarbons and thereby reduces their viscosity. The reduced-viscosity hydrocarbons (as shown by solid arrows) drain downward by gravity through openings (e.g., a slotted liner) of the production well 204, and into the production tubing 206. The hydrocarbons are produced to the surface via the production tubing 206.

FIG. 3A is a schematic depiction of the injection tubing 202 and production tubing 206 of a SAGD well system in a subterranean reservoir 210 before steam injection. The subterranean reservoir contains hydrocarbons, as shown by hydrocarbon molecules 214, and $H_2S$, as shown by $H_2S$ molecules 216.

Figure 3B:
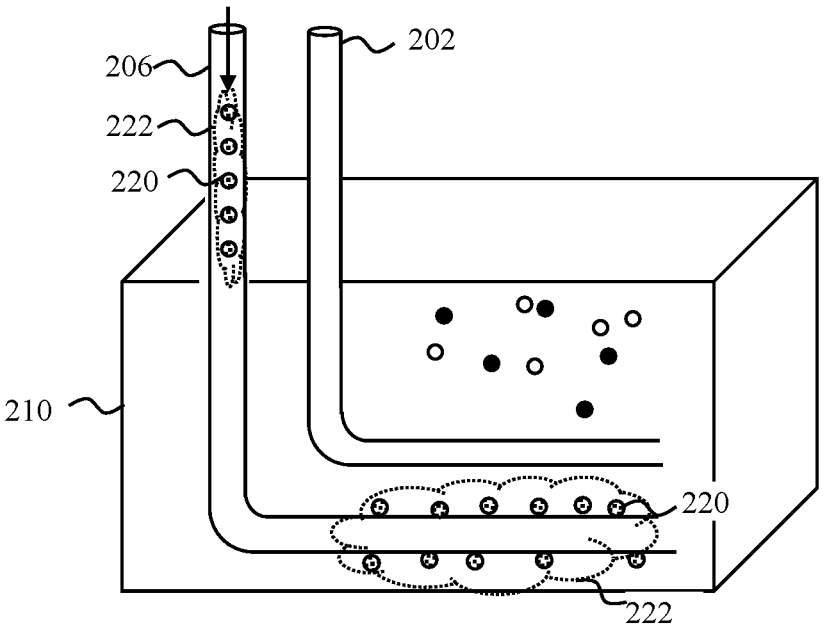
Figure 3C:
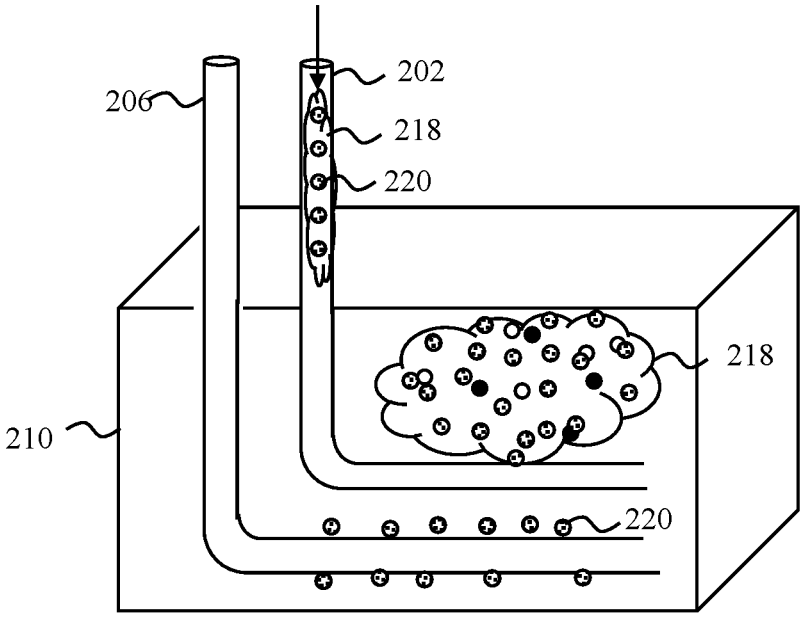

Referring back to FIG. 1, at step 100, a mixture of steam and $H_2S$-sorbent particles are injected, via the injection tubing string 202, into the subterranean reservoir. That is, $H_2S$-sorbent particles are injected in the steam phase of the SAGD operation. FIG. 3C is schematic depiction of step 100, showing steam 218 mixed with $H_2S$-sorbent particles 220 being pumped into the subterranean reservoir 210. The $H_2S$-sorbent particles 220 can be suspended in the injected steam 218 even at relatively low flow velocities of the injected steam, on account of the small size of the $H_2S$-sorbent particles.

A variety of $H_2S$-sorbent particles may be used in the present invention to adsorb $H_2S$ in the subterranean reservoir. Non-limiting examples are described below under the heading "$H_2S$-sorbent particles." It will be evident that the $H_2S$-sorbent particles should have high affinity for $H_2S$-sorbent particles at pressure and temperatures conditions in the subterranean reservoir, and relatively little to no affinity for hydrocarbons in the subterranean reservoir under those conditions.

Preferably, the selected $H_2S$-sorbent particles are capable of adsorbing $H_2S$ over the full range of temperatures expected to be encountered in the steam chamber of a SAGD well system, which typically ranges from about 15° C. to about 300° C. In particular embodiments, the $H_2S$-sorbent particles may have high affinity for $H_2S$ at temperatures of about 110° C. or greater, more particularly of about 200° C. or greater, and even more particularly, of about 230° C. or greater, to about 300° C. In this regard, calcium oxide (CaO) and iron oxide ($Fe_2O_3$) are reported to have been effective for $H_2S$ removal at high temperatures.

The $H_2S$-sorbent particles should be sized so that they can permeate through the pores of the subterranean reservoir, without substantially impairing transmission of a liquid or gaseous fluid through the subterranean reservoir. A suitable size of $H_2S$-sorbent particles may be selected having regard to the characteristics of a particular subterranean reservoir. As a non-limiting example, for subterranean reservoirs containing oil sands in Alberta, Canada, a suitable maximum dimension (e.g., diameter) of $H_2S$-sorbent particles may be less than about 1,000 nm, more particularly less than about 500 nm, and even more particularly less than about 250 nm.

In some embodiments, the $H_2S$-sorbent particles may be nanoparticles—i.e., particles having a maximum dimension (e.g., diameter) less than about 100 nm, more particularly less than about 50 nm, and even more particularly less than about 25 nm.

Use of $H_2S$-sorbent particles having higher surface area per mass may increase their efficacy in adsorption of the $H_2S$ gas. In embodiments, the $H_2S$-sorbent particles have a surface area per mass in the range from about 1 to about 3,000 $m^2/g$. In some embodiments, the surface area per mass may be greater than 50 $m^2/g$, greater than about 100 $m^2/g$, greater than about 250 $m^2/g$, greater than about 500 $m^2/g$, greater than about 750 $m^2/g$, and greater than about 1,000 $m^2/g$.

The $H_2S$-sorbent particles may be selected to have a desired adsorption capacity, having regard to factors such as the amount or concentration of the $H_2S$ gas to be sequestered, or a desired rate of sequestration. For example, they may have an adsorption capacity (mg $H_2S$/g sorbent material) in the range from about 0.1-15,000 mg/g. In some embodiments, the adsorption capacity may be greater than about 10 mg/g, more particularly greater than about 50 mg/g, more particularly greater than about 100 mg/g, more particularly greater than about 500 mg/g, and more particularly greater than about 1,000 mg/g.

Having regard to the $H_2S$ affinity of the selected $H_2S$-sorbent particles, the concentration of $H_2S$-sorbent particles in the mixture may be selected to be effective in absorbing $H_2S$ present in concentrations in the hydrocarbons in the subterranean reservoir, which typically range from about 100 ppm to about 30,000 ppm.

Figure 3D:
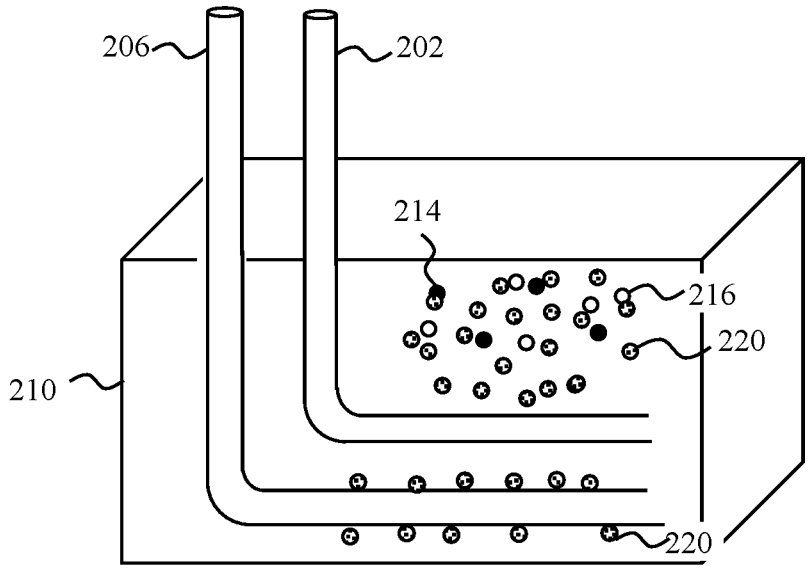

In FIG. 1, at step 102, the $H_2S$-sorbent particles that were injected into the subterranean reservoir in step 100, are allowed to attach to the subterranean reservoir. This step may be performed without any active intervention, by allowing for relatively quiescent conditions in the subterranean reservoir. For example, injection of the steam is ceased to leave the $H_2S$-sorbent particles in the subterranean reservoir relatively undisturbed. The $H_2S$-sorbent particles will adhere to sand particles in the subterranean reservoir, owing to the small size of the $H_2S$-sorbent particles. FIG. 3D is schematic depiction of step 102, showing the $H_2S$-sorbent particles 220 attached to sand particles of the subterranean reservoir 210 after cessation of steam injection.

In FIG. 1, at step 104, the $H_2S$-sorbent particles are allowed to adsorb hydrogen sulfide ($H_2S$) in the subterranean reservoir. FIG. 3D is a schematic depiction of this step showing the $H_2S$-sorbent particles 220 attached to sand particles of the subterranean reservoir 210 and the adsorbed $H_2S$ molecules 216.

Figure 3E:
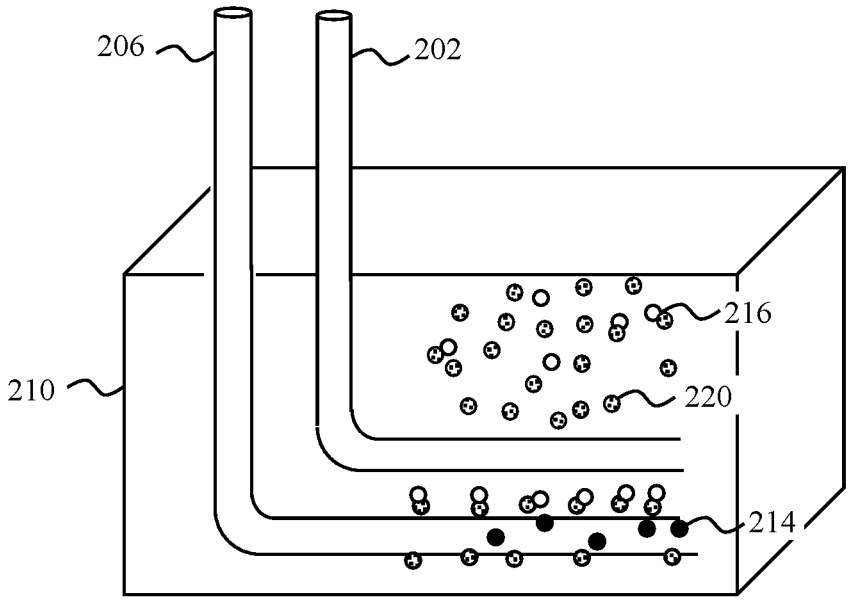

In FIG. 1, at step 106, the hydrocarbons are allowed to drain by gravity into the production tubing string, while the $H_2S$-sorbent particles with adsorbed $H_2S$ remain attached to the subterranean reservoir. FIG. 3E is a schematic depiction of this step showing hydrocarbon molecules 214 within the production tubing 206 while the $H_2S$-sorbent particles 220 and adsorbed $H_2S$ molecules 216 remain in the region of the steam chamber.

Figure 3F:
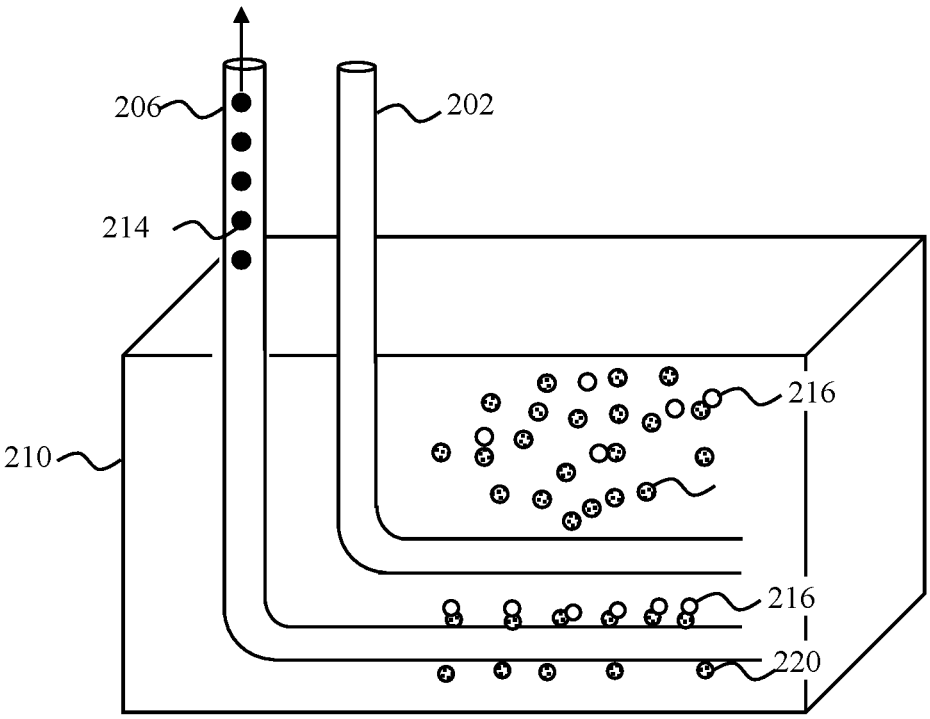

In FIG. 1, at step 108, the hydrocarbons are produced to the surface via the production tubing. FIG. 3F is a schematic depiction of this step showing the hydrocarbon molecules 214 flowing to the surface via the production tubing 206.

As known to persons skilled in the art, SAGD (and other steam injection operations as described below) may be performed over many years with multiple cycles of a steam injection phase followed by a hydrocarbon production phase. Accordingly, steps 100 to 108 may be performed repeatedly in cycles, with each performance of step 100 corresponding to a steam injection phase of a cycle, and each performance of step 108 corresponding to a hydrocarbon production phase of the cycle. In particular, the amount or concentration of $H_2S$-sorbent particles in the mixture that is injected into the subterranean reservoir at each cycle may be selectively varied, possibly to account for factors such as the amount or concentration of $H_2S$-sorbent particles that have been previously injected in past cycles, or will be injected in subsequent cycles. This can be used to achieve a variety of advantageous effects. As one example, the concentration or amount of $H_2S$-sorbent particles that is injected in any given cycle can be limited, with a view to incrementally increasing the concentration or amount of $H_2S$-sorbent particles attached to the subterranean reservoir over multiple cycles. As another example, the concentration or amount of $H_2S$-sorbent particles that is injected in any given cycle can be selected to control the distribution of $H_2S$-sorbent particles in the subterranean reservoir. For instance, the volumetric portion of the subterranean reservoir that is "seeded" with the $H_2S$-sorbent particles can be incrementally increased over multiple cycles. As still another example, the concentration or amount of $H_2S$-sorbent particles in the mixture that is injected in any given cycle can be varied over cycles to account for varying levels of $H_2S$ concentration in produced fluids during the operation of the well, or to selectively vary the $H_2S$ concentration of fluids produced to the surface during the operation of the well.

Referring back to FIG. 1, the method may also include an optional step 110 that is applicable to steam injection operations, such as SAGD or steam flooding that use two wells, where one of the wells is an injection well for injection of steam, and the other well is a production well for production of hydrocarbons to the surface. At step 110, a mixture of a carrier fluid and additional $H_2S$-sorbent particles are injected via the production tubing string 206 of the production well 204 into the subterranean reservoir. That is, the production tubing string 206 is used in a non-conventional manner to convey material from the surface into the subterranean reservoir. FIG. 3B is a schematic depiction of step 110, showing the carrier fluid 222 mixed with additional $H_2S$-sorbent particles 220 being pumped into the subterranean reservoir. In embodiments, the carrier fluid 222 may be a liquid such as water. In embodiments, the carrier fluid 222 may be a gas, such as a nitrogen. The carrier fluid may be transported to the well head of the production well such as by truck or other means. In like manner as the $H_2S$-sorbent particles that are injected at step 100, the additional $H_2S$-sorbent particles that are injected in step 110 will attach the subterranean reservoir (but more so in the vicinity of the production well), adsorb $H_2S$ in the subterranean reservoir including from the hydrocarbons that have drained by gravity from the steam chamber, and sequester the $H_2S$ particles in the subterranean reservoir as the hydrocarbons are produced to the surface. FIG. 1, and the sequence of FIGS. 3A to 3F, show step 110 as being performed prior to steps 100 to 108. However, it will be understood that step 110 may be performed periodically, and in other orders relative to these steps, but preferably in such an order that does not interfere with migration of hydrocarbons to the production well, and production of hydrocarbons to the surface via the production well. Further, by use of flow control devices associated with the production well, the carrier fluid and additional $H_2S$-sorbent particles may be injected into those portions of the subterranean reservoir surrounding production well where non-condensable gases (including $H_2S$) are most likely to be produced. Such locations may be predicted by persons skilled in the art, and/or determined empirically when the well system is in operation.

Controlled Placement of $H_2S$-Sorbent Particles.

The contact time between non-condensable gases and the $H_2S$-sorbent particles in the subterranean reservoir may be quite brief due to flow of the gas phase. As such, creating regions of the subterranean reservoir that have higher concentrations of $H_2S$-sorbent particles, and preferentially promoting flow of non-condensable gases (including $H_2S$) through such regions may promote contact of $H_2S$ with the $H_2S$-sorbent particles, and therefore make the most economical and effective use of the $H_2S$-sorbent particles.

As a non-limiting example, referring back to the FIG. 2, the injection tubing 202 may include a plurality of steam flow control devices, including a first steam flow control device 224 and a second steam flow control device 226, disposed at different positions along the subterranean reservoir. "Steam flow control device", as used herein, refers to any mechanical device that can be incorporated into a downhole string, and actuated to selectively control flow of steam out of the downhole tubing and into the surrounding wellbore. (Steam flow control devices are known to persons skilled in the art, and by themselves do not constitute part of the present invention. Steam flow control devices may be referred to in the art as "steam splitters", "steam diverter", "steam valves", "steam injection mandrels", and like terms. As a non-limiting example, a steam flow control device may comprise a body defining a bore, and a sleeve or other valve member that is movable relative to the body between alternate positions that either block or allow steam to flow out of openings defined by the bore. Movement of the sleeve or valve member may be actuated by means such as shift tools, balls, or other mechanisms as known to persons skilled in the art.)

By control of the steam flow control devices (and the use of possible sealing elements associated with the injection tubing 202, such as sealing elements used for zonal isolation), it is possible to establish pressure gradients of the steam mixed with $H_2S$-sorbent particles 220 that are injected into the subterranean reservoir in step 100. These pressure gradients will affect the distribution of $H_2S$-sorbent particles 220, as the injected steam and $H_2S$-sorbent particles 220 will tend to migrate from regions of higher pressure to regions of lower pressure. In FIG. 2, for example, closing of the first steam flow control device 224 and opening of the second steam flow control device 226 may create a region of relatively lower pressure in the vicinity of the first steam flow control device 224, and a region of relatively higher pressure in the vicinity of the second steam flow control device 226. Accordingly, $H_2S$-sorbent particles 220 injected into the subterranean formation via the second steam flow control device 226 may tend to flow from right to left in the drawing plane of FIG. 2. This may result in a region having a higher concentration of $H_2S$-sorbent particles 220 in the vicinity of the second steam flow control device 226, as compared with the region in the vicinity of the first steam flow control device 224. (The $H_2S$-sorbent particles 220 would be expected to become more diffuse in concentration with increased distance from their injection location at the second steam flow control device 226.)

Pressure gradients also tend to cause non-condensable gases in the steam chamber 212 to flow from regions of relatively high pressure to regions of relatively low pressure. Accordingly, the steam flow control devices or other means may also be selectively controlled to establish a pressure gradient that affects the flow of non-condensable gases in the steam chamber 212 to regions of the steam chamber 212 having relatively higher concentrations of $H_2S$-sorbent particles 220. For example, after the $H_2S$-sorbent particles 220 are allowed to attach the sand particles of the subterranean reservoir, injection of steam (without further injection $H_2S$-sorbent particles 220) into the steam chamber 212 may be continued. Opening of the first steam flow control device 224 and closing of the second steam flow control device 226 may create a region of relatively higher pressure in the vicinity of the first steam flow control device 224, as compared with the region in the vicinity of the second steam flow control device 226. Accordingly, non-condensable gases (possibly including hydrogen sulfide) will tend to flow from left to right in the drawing plane of FIG. 2, so as to flow through the region of the steam chamber 212 in the vicinity of the second steam flow control device 226 having the relatively higher concentration of $H_2S$-sorbent particles 220, preferentially over other regions having relatively lower concentrations of $H_2S$-sorbent particles 220.

Adaption to Other Well Systems and Steam Injection Operations.

In the embodiment of FIGS. 3A to 3F, the method is implemented using a SAGD well system. In other embodiments, the method may be implemented for other steam injection operations, including cyclic steam stimulation (CSS), steam flooding or steam drive.

As known in the art, cyclic steam stimulation typically involves a "steam phase" of injecting steam into the reservoir via the well, a "soak phase" of allowing the steam to soak into the reservoir in the vicinity of the well and thereby reduce viscosity of hydrocarbons, and a "production phase" of producing hydrocarbons to the surface from the same well. The method of the present invention may be implemented by: injecting a mixture of steam and $H_2S$-sorbent particles into the subterranean reservoir via the well during the "steam phase"; allowing $H_2S$-sorbent particles to attach to the subterranean reservoir, and adsorb hydrogen sulfide ($H_2S$) in the subterranean reservoir during the "soak phase"; and producing the hydrocarbons to the surface via the same well during the "production phase", without producing the $H_2S$-sorbent particles with adsorbed $H_2S$ that remain attached to the subterranean reservoir, Thus, it will be understood that the method may be implemented using a single well system, which may be a vertical well.

As known in the art, steam flooding or steam drive typically involves injecting steam into a reservoir via a first well to reduce the viscosity of hydrocarbons and displace the hydrocarbons toward a different second well. In contrast to SAGD, the first well and the second well may both be entirely vertical wells that are horizontally spaced apart from each other. The method of the present invention may be implemented by: injecting a mixture of steam and $H_2S$-sorbent particles into the subterranean reservoir via the first well; allowing $H_2S$-sorbent particles to attach to the subterranean reservoir that is disposed horizontally between the first and second wells, and adsorb hydrogen sulfide ($H_2S$) in that subterranean reservoir; and producing the hydrocarbons to the surface via the second well, without producing the $H_2S$-sorbent particles with adsorbed $H_2S$ that remain attached to the subterranean reservoir. Thus, it will be understood that the method may be implemented using a dual well system having a pair of entirely vertical wells.

$H_2S$-Sorbent Particles.

The following description provides non-limiting examples of particles that are believed would be useful in the present invention to adsorb $H_2S$ in the subterranean reservoir, and a line of reasoning for their use. In general, References no. 1 to 14, below, provide information regarding efficacy of nanoparticles for adsorption of $H_2S$. It is believed that such nanoparticles would be effective in adsorption of at least some amount of $H_2S$ in temperature and pressure conditions typically encountered in a subterranean reservoir.

Zinc Oxide (ZnO) Particles.

Zinc oxide and $H_2S$ react to produce zinc sulfide (ZnS) and water, according to the following reaction.

$$ZnO_{(s)}+H_2S_{(g)}\rightarrow ZnS_{(s)}+H_2O_{(l)}$$

Zinc oxide particles are typically a solid, white, and odorless powder. Zinc oxide may be more stable and cost effective when compared with other adsorbents. A possible disadvantage is the limited feasibility of regeneration—i.e., desorption of adsorbed $H_2S$ to render the particle able to adsorb $H_2S$ again.

Reference no. 1 [Awume] reports performance characteristics of zinc oxide nanoparticles in the removal of $H_2S$ from gas streams. At ambient temperatures zinc oxide nanoparticles are up to 99% effective in capturing $H_2S$ gas. As feed $H_2S$ concentrations increases, the adsorption capacity also increases and the nanoparticles reach a saturation state more quickly, as summarized below in Table 1. Smaller zinc oxide nanoparticles (18 nm) have an overall higher adsorption capacity compared to larger particles (80 nm-200 nm). Larger zinc oxide nanoparticles, however, reached their saturation state faster, regardless of $H_2S$ feed concentration.

TABLE 1

| $H_2S$ Feed Concentration (mg/L) | Equilibrium $H_2S$ Adsorbed (g/g adsorbent) |
|---|---|
| 94.70 | 9.2 |
| 233.43 | 9.8 |
| 540.60 | 10.6 |
| 814.76 | 10.6 |
| 964.2 | 11.4 |
| 1501.85 | 14.9 |

The saturation rate of adsorbent is unaffected by temperature, but the adsorption capacity of zinc oxide nanoparticles increases with an increase in temperature, as summarized below in Table 2.

TABLE 2

| Temperature (° C.) | 541.4 mg/L Equilibrium $H_2S$ Adsorbed (g/g adsorbent) | 1567.8 mg/L Equilibrium $H_2S$ Adsorbed (g/g adsorbent) |
|---|---|---|
| 1 | 8.35 | — |
| 11 | 9.21 | 12 |
| 22 | 10.58 | 14.9 |
| 41 | 11.17 | 16.6 |

Adsorption capacities increase with an increase in the zinc oxide nanoparticle quantity. The saturation rate of the adsorbent was higher with a decrease in nanoparticle quantity, regardless of the $H_2S$ feed concentration.

Synthesized zinc oxide nanoparticles (14-25 nm) can completely remove $H_2S$ from water-based drilling mud in ~15 minutes, whereas bulk zinc oxide can remove ~2.5% of $H_2S$ in as long as 90 minutes under the same operating conditions.

Reference no. 6 [Whittaker] describes NanoActive™ Sulphur Scavenger (NASS) (Timilon Technology Acquisitions LLC; Naples, FL, USA), which is a zinc oxide (ZnO) nanoparticle sulphur recovery technology developed for the neutralization of $H_2S$ in crude oil and gas streams. Whittaker reports that NASS's two-step decomposition mechanism (adsorption by physisorption, followed by nonreversible chemical decomposition) substantially enhances its detoxification abilities because decomposition is less dependent on temperature. Whittaker reports that use of NASS™ improves scavenger efficacy between 4 and 6 times, depending on feed composition. Whittaker reports that the range at which NASS stand-alone systems are economical is up to 10,000 ppm $H_2S$ in liquid streams, and 1,000 ppm $H_2S$ at 320 $m^3$/hr to 10,000 ppm $H_2S$ at 30 $m^3$/hr in gas streams. At these levels, NASS reduces $H_2S$ to 0 ppm. For higher concentrations, NASS is used in combination with existing removal technologies.

Iron Oxide ($Fe_2O_3$) Particles.

Iron oxide reacts with $H_2S$ to produce iron sulfide (FeS) and water, according to the following reaction.

$$Fe_2O_3+3H_2S\rightarrow Fe_2S_3+3H_2O$$

Iron oxide nanoparticles have been shown to be very effective for $H_2S$ removal from gas streams at temperatures in excess in 300° C. Reference no. 12 [Blatt et al.] indicates that impregnating a custom-activated carbon with these nanoparticles resulted in a slight enhanced removal efficiency.

SULFATREAT™ (Schlumberger Limited, Houston, TX, USA) is a granular iron oxide based $H_2S$ adsorbent and SELECT FAMILY™ (Schlumberger Limited, Houston, TX, USA) is a mixed metal oxide-based $H_2S$ adsorbent, both of which are used to remove $H_2S$ from gas streams in fixed bed processes. It is possible that these sorbents may be physically reduced to nanoparticle size.

Magnetite ($Fe_3O_4$) Particles.

Magnetite reacts with $H_2S$ at low pH to form hydrogen as a byproduct, according to the following equation.

$$Fe_3O_4+6H_2S\rightarrow 3FeS_2+4H_2O+2H_2$$

Reference no. 4 [Martinez et al.] reports that magnetite nanoparticles have reached more than 93% in $H_2S$ mitigation.

Copper Oxide (CuO) Particles.

Copper oxide reacts with $H_2S$ is according to the following equation.

$$CuO+H_2S\rightarrow CuS+H_2O$$

Reference no. 4 [Martinez et al.] reports that copper oxide is thermodynamically favorable for sulphur removal, and that the reaction between copper oxides and sulfides is very fast and effective. Also, this oxide can be reduced to the metallic copper easily.

Reference no. 7 [Georgiadis et al.] reports that the presence of copper increased the mobility of sulfur anions in Cu-containing ZnS particles. Georgiadis et al. also reports that CuO has an extremely high equilibrium sulfidation constant that allows an extremely low equilibrium constant even at high temperatures.

Adsorbents with high Cu concentrations have been shown to be more efficient in capturing $H_2S$ compared to adsorbents with high Zn concentrations.

Nickel Oxide (NiO) Particles.

Nickel oxide reacts with $H_2S$ is according to the following equation.

$$NiO+H_2S\rightarrow NiS+H_2O$$

Reference no. 4 [Martinez et al.] reports results in $H_2S$ mitigation (83%) in studies of the application of nickel nanoparticles to treat heavy crude oil, Martinez et al. reports that three faces of nickel were generated (NiO, Ni° and $Ni_2S_3$), and for this reason, it was difficult to determine which material is working as the scavenger.

Gold (Au) Particles.

Reference no. 8 [Mubeen et al.] reports that $H_2S$ is known to adsorb strongly onto gold because of the high chemical affinity between gold and sulphur. At temperatures between 165° K. and 520° K., $H_2S$ decomposes to form SH which is chemisorbed onto the gold surface while $H_2$ is released. However, gold nanoparticles are a very expensive option and there is not much literature relating to gold and $H_2S$ adsorption.

Calcium Oxide (CaO) Particles.

Calcium oxide reacts with $H_2S$ is according to the following equation.

$$CaO+H_2S \rightarrow CaS+H_2O$$

Reference no. 10 [Wang] reports that calcium oxide a good choice for $H_2S$ adsorption at elevated temperatures (250-500° C.).

Manganese Oxide ($MnO_2$) Particles.

Manganese oxide reacts non-catalytically with $H_2S$ is according to the following equation.

$$MnO_2+2H_2S \rightarrow MnS+S+2H_2O$$

Reference no. 9 [Konkol et al.] reports that desulphurization performance of different metallic oxides on activated carbon decreases in the following order: Mn>Cu>Fe>Ce>Co>V.

Molybdenum Oxide ($MoO_2$) Particles.

Reference no. 13 [Hassankiadeh et al.] reports that molybdenum oxide nanoparticles have an adsorption capacity of 0.081 and 0.074 g $H_2S$/g molybdenum oxide in low temperature and low concentration of $H_2S$ using non-spherical and spherical molybdenum oxide sorbent, respectively.

Metal-Organic Frameworks.

Non-limiting examples of MOFs that maybe used to adsorb $H_2S$ are reviewed by Georgiadis et al. [Reference no. 7], and Georgiadis et al. [Reference no. 22], including MOFs based on vanadium, aluminum, chromium, titanium, zeolites, zinc, zinc oxide, zirconium oxide, graphite oxide, and MOF's known as M-MOF-74, and Ni-MOF-74.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

REFERENCES

All publications, patents and patent applications mentioned in this specification are indicative of the level of skill of those skilled in the art to which this invention pertains and are herein incorporated by reference, where permitted, to the same extent as if each individual publication, patent, or patent applications was specifically and individually indicated to be incorporated by reference.

Non-Patent Literature

1. Awume, Bennet. Control of Hydrogen Sulphide Emissions Using Zinc Oxide Nanoparticles. Thesis, University of Saskatchewan. July 2014.
2. Sekhavatjou, M., Moradi, R., Hosseini Alhashemi, A., & Taghinia Hejabi, A. A New Method For Sulphur Components Removal From Sour Gas Through Application of Zinc And Iron Oxides Nanoparticles. International Journal of Environmental Research (IJER) 8(2), 273-278. 2014.

3. Abdelrahman Ibrahim El-Diasty, SPE, The American University in Cairo (AUC) and Suez University, Egypt and Adel M. Salem Ragab. Applications of Nanotechnology in the Oil & Gas Industry: Latest Trends Worldwide & Future Challenges in Egypt. Society of Petroleum Engineers. 2013.
4. S. I. Martinez, PDVSA Intevep S.A.; C. Bastidas, Universidad Nacional Experimental Politécnica de la Fuerza Armada. Application of Transition Metal Nanoparticles in the Streams Production of Heavy Crude Oil Treatment: $H_2S$ Mitigation. Society of Petroleum Engineers. 2017.
5. Christof Weinlaender, Raphael Neubauer, Christoph Hochenauer. Low-temperature $H_2S$ removal for solid oxide fuel cell application with metal oxide adsorbents. Oct. 7, 2016.
6. S. L. Whittaker, Clean Stream Technologies Middle East FZE. Use of NanoActive® Sulphur Scavenger NASS for $H_2S$ Removal in the Oil and Gas Industry. Society of Petroleum Engineers. 2018.
7. Amvrosios G. Georgiadis, Nikolaos D. Charisiou and Maria A. Goula. Removal of Hydrogen Sulfide From Various Industrial Gases: A Review of The Most Promising Adsorbing Materials. May 8, 2020.
8. Syed Mubeen, Ting Zhang, Nicha Chartuprayoon, Youngwoo Rheem, Ashok Mulchandani, Nosang V. Myung, and Marc A. Deshusses. Sensitive Detection of $H_2S$ Using Gold Nanoparticles Decorated SWNTs. Anal. Chem. 2010; 82(1); 250-257.
9. Izabela Konkol, Jan Cebula, Adam Cenian. Oxidization of hydrogen sulphide in biogas by manganese (IV) oxide particles. Environmental Engineering Research. 2021; 26(2): 190343 (eeer.org).
10. Wang, De Ming. "Breakthrough behavior of $H_2S$ removal with an iron oxide based CG-4 adsorbent in a fixed-bed reactor." Thesis, University of Saskatchewan. September 2008.
11. Costa, C.; Cornacchia, M.; Pagliero, M.; Fabiano, B.; Vocciante, M.; Reverberi, A. P. Hydrogen Sulfide Adsorption by Iron Oxides and Their Polymer Composites: A Case-Study Application to Biogas Purification. Materials 2020, 13, 4725.
12. Blatt, O., Helmich, M., Steuten, B., Hardt, S., Bathen, D. and Wiggers, H. (2014), Iron Oxide/Polymer-Based Nanocomposite Material for Hydrogen Sulfide Adsorption Applications. Chem. Eng. Technol., 37: 1938-1944.
13. Nabipoor Hassankiadeh, Mojtaba & Hallajisani, Ahmad. (2020). Abstract of Application of Molybdenum oxide nanoparticles in $H_2S$ removal from natural gas under different operational and geometrical conditions. Journal of Petroleum Science and Engineering. 190.
14. Alberta Energy and Utilities Board, Interim Directive ID 2001-3. Sulphur Recovery Guidelines for the Province of Alberta. Aug. 29, 2001.
15. Ravinder Kumar, Rajesh Mangalapuri, Mohammad Hossein Ahmadi, Dai-Viet N Vo, Rajniesh Solanki, Pawan Kumar, The role of nanotechnology on post-combustion $CO_2$ absorption in process industries, International Journal of Low-Carbon Technologies, Volume 15, Issue 3, August 2020, Pages 361-367.
16. Kim, Jinguk & Fu, Qiang & Xie, K. & Scofield, Joel & Kentish, Sandra & Qiao, Greg. (2016). $CO_2$ Separation using Surface-functionalized SiO2 Nanoparticles incorporated Ultra-Thin Film Composite Mixed Matrix Membranes for Post-combustion Carbon Capture. Journal of Membrane Science. 515.
17. Lin K Y, Park A H. Effects of bonding types and functional groups on $CO_2$ capture using novel multiphase systems of liquid-like nanoparticle organic hybrid materials. Environ Sci Technol. 2011 Aug. 1; 45(15):6633-9.
18. Ota, M.; Hirota, Y.; Uchida, Y.; Nishiyama, N. $CO_2$ Adsorption Property of Amine-Modified Amorphous TiO2 Nanoparticles with a High Surface Area. Colloids Interfaces 2018, 2, 25.
19. Zhang, Huiying & Liu, Ruiqiang & Ning, Tangyuan & Lal, Rattan. (2018). Higher $CO_2$ absorption using a new class of calcium hydroxide (Ca(OH)2) nanoparticles. Environmental Chemistry Letters.
20. Isahak, Wan & Che Ramli, Zatil Amali & Lahuri, Azizul & Yusop, Rahimi & Wahab, Mohamed & Yarmo, Ambar. (2015). Enhancement of $CO_2$ Capture Using CuO Nanoparticles Supported on Green Activated Carbon. Advanced Materials Research. 1087. 111-115.
21. Mishra, Ashish & Sundara, Ramaprabhu. (2011). Nano magnetite decorated multiwalled carbon nanotubes: A robust nanomaterial for enhanced Carbon Dioxide adsorption. Energy Environ. Sci. 4. 889-895.
22. Georgiadis, A. G.; Charisiou, N. D.; Yentekakis, I. V.; Goula, M. A. Removal of Hydrogen Sulfide (H2S) Using MOFs: A Review of the Latest Developments. Chem. Proc. 2020, 2, 27.

PATENT DOCUMENTS

23. Canadian patent application publication no. 2,897,078 A1 (Sun et al.; Jan. 1, 2016), titled "Systems and Methods for Removal of Sulfur from Flue Gas".
24. Canadian patent application publication no. 2,915,623 A1 (Gupta et al; Dec. 18, 2015), titled "Separation of Carbon Dioxide from Flue Gases".
25. Canadian patent application publication no. 2,916,141 A1 (Chhina et al; Dec. 22, 2015), titled "Methods, Systems and Apparatuses for Capturing and Sequestering Carbon Dioxide Emitted from a Vehicle".

The claimed invention is:

1. A method for producing hydrocarbons from a subterranean reservoir, the method comprising the steps of:

(a) injecting a mixture of steam and $H_2S$-sorbent nanoparticles into the subterranean reservoir;

(b) allowing the steam to decrease viscosity of the hydrocarbons in the subterranean reservoir, and allowing at least some of the $H_2S$-sorbent nanoparticles to attach to the subterranean reservoir to thereby become attached $H_2S$-sorbent nanoparticles;

(c) allowing the $H_2S$-sorbent nanoparticles to adsorb hydrogen sulfide ($H_2S$) in the subterranean reservoir; and (d) producing the hydrocarbons from the subterranean reservoir, while the attached $H_2S$-sorbent nanoparticles with adsorbed $H_2S$ remain attached to the subterranean reservoir.

2. The method of claim 1, wherein:

in step (a), the mixture of steam and $H_2S$-sorbent nanoparticles is injected into the subterranean reservoir via a well; and in step (d), the hydrocarbons are produced to the surface via the well that was used in step (a) to inject the mixture of steam and $H_2S$-sorbent nanoparticles into the subterranean reservoir.

3. The method of claim 1, wherein:

in step (a), the mixture of steam and $H_2S$-sorbent nanoparticles is injected into the subterranean reservoir via a first well; and in step (d), the hydrocarbons are produced to the surface via a second well that is different from the first well.

4. The method of claim 3, wherein:

the method uses a steam assisted gravity drainage (SAGD) well system, wherein the first well is an injection well comprising a horizontal or deviated injection well leg, and the second well is a production well comprising a horizontal or deviated production well leg below the injection well leg; and the method comprises, after step (c) and before step (d), the further step of allowing hydrocarbons in the subterranean reservoir to drain by gravity into the production well leg, while the attached $H_2S$-sorbent nanoparticles with adsorbed $H_2S$ remain attached to the subterranean reservoir.

5. The method of claim 3, wherein the method comprises, either before or after step (a), the further steps of:

(e) injecting a mixture of a carrier fluid and additional $H_2S$-sorbent nanoparticles into the subterranean formation via the second well;

(f) allowing at least some of the additional $H_2S$-sorbent nanoparticles to become additional, attached $H_2S$-sorbent nanoparticles and to adsorb hydrogen sulfide ($H_2S$) in the subterranean reservoir; and (g) producing the hydrocarbons from the subterranean reservoir, while the additional, attached $H_2S$-sorbent nanoparticles with adsorbed $H_2S$ remain attached to the subterranean reservoir.

6. The method of claim 5, wherein the carrier fluid comprises a liquid.

7. The method of claim 5, wherein the carrier fluid comprises a gas.

8. The method of claim 1, wherein:

step (a) of injecting the mixture of steam and $H_2S$-sorbent nanoparticles creates a first region of $H_2S$-sorbent nanoparticles and a second region of $H_2S$-sorbent nanoparticles in the subterranean reservoir, wherein a concentration of $H_2S$-sorbent nanoparticles in the first region is higher than a concentration of $H_2S$-sorbent nanoparticles, if any, in the second region; and wherein the method further comprises establishing a pressure gradient in the subterranean reservoir that directs $H_2S$ through the first region in preference to the second region.

9. The method of claim 1, wherein steps (a) to (d) are performed in a first cycle, and then steps (a) to (d) are repeated in a second cycle.

10. The method of claim 9, wherein step (a) of the first cycle injects a first amount or concentration of $H_2S$-sorbent nanoparticles in the mixture into the subterranean formation, and step (a) of the second cycle injects a second amount or concentration of $H_2S$-sorbent nanoparticles in the mixture into the subterranean formation, wherein the second amount or concentration is different from the first amount or concentration.

11. The method of claim 1, wherein the $H_2S$-sorbent nanoparticles comprise a material selected from the group consisting of a metal-organic framework (MOF), zinc oxide (ZnO) iron oxide ($Fe_2O_3$), magnetite ($Fe_3O_4$), copper oxide (CuO), nickel oxide (NiO), calcium oxide (CaO), manganese oxide ($MnO_2$), and molybdenum oxide ($MoO_2$).

12. A method for reducing an amount of $H_2S$ produced along with hydrocarbons from a subterranean reservoir accessed via a steam assisted gravity drainage (SAGD) well system including an injection well comprising a horizontal or deviated injection well leg and a production well comprising a horizontal or deviated production well leg below the injection well leg, the method comprising the steps of:

injecting into the subterranean reservoir via the injection well, a mixture of steam and $H_2S$-sorbent nanoparticles, the $H_2S$-sorbent nanoparticles comprising a material selected from the group consisting of a metal-organic framework (MOF), zinc oxide (ZnO) iron oxide ($Fe_2O_3$), magnetite ($Fe_3O_4$), copper oxide (CuO), nickel oxide (NiO), calcium oxide (CaO), manganese oxide ($MnO_2$), and molybdenum oxide ($MoO_2$);

ceasing injection of the mixture of steam and $H_2S$-sorbent nanoparticles into the subterranean reservoir, wherein the subterranean reservoir has a temperature of about 110° C. to about 300° C.;

decreasing viscosity of the hydrocarbons in the subterranean reservoir with the injected steam;

allowing at least some of the $H_2S$-sorbent nanoparticles to attach to the subterranean reservoir, and thereby become attached $H_2S$-sorbent nanoparticles; and adsorbing hydrogen sulfide ($H_2S$) in the subterranean reservoir with the $H_2S$-sorbent nanoparticles;

draining hydrocarbons in the subterranean reservoir by gravity into the production well leg, while the attached $H_2S$-sorbent nanoparticles with adsorbed $H_2S$ remain attached to the subterranean reservoir; and producing the hydrocarbons from the subterranean reservoir via the production well, wherein producing leaves the attached $H_2S$-sorbent nanoparticles with adsorbed $H_2S$ in the subterranean reservoir, to thereby reduce the $H_2S$ in the produced hydrocarbons.

13. The method of claim 1, wherein the $H_2S$-sorbent nanoparticles comprise iron oxide, or calcium oxide.

* * * * *